US007562781B2

(12) United States Patent
Kandoth-Kannoth et al.

(10) Patent No.: US 7,562,781 B2
(45) Date of Patent: Jul. 21, 2009

(54) AUTOMATIC CUT LEVER APPARATUS

(76) Inventors: Harish K. Kandoth-Kannoth, 3178 Foxridge Ct., Woodridge, IL (US) 60517; Anand R. Vithani, 817 Kings Point Dr. W., Addison, IL (US) 60101; David C. Brabb, 5828 S. Kolmar Ave, Chicago, IL (US) 60829; Robert S. Trent, 1819 Wesley Ave., Berwyn, IL (US) 60402

( * ) Notice: Subject to any disclaimer, the term of this patent is extended or adjusted under 35 U.S.C. 154(b) by 167 days.

(21) Appl. No.: 11/602,445

(22) Filed: Nov. 20, 2006

(65) Prior Publication Data

US 2007/0114199 A1 May 24, 2007

Related U.S. Application Data

(60) Provisional application No. 60/738,295, filed on Nov. 18, 2005.

(51) Int. Cl.
*B61G 1/00* (2006.01)

(52) U.S. Cl. ..... 213/166; 213/168; 213/169; 213/170; 213/159

(58) Field of Classification Search ..... 213/159–169
See application file for complete search history.

(56) References Cited

U.S. PATENT DOCUMENTS 2,009,426 A * 7/1935 Bazeley ..... 213/170
2,051,361 A * 8/1936 Bazeley ..... 213/170
2,202,666 A * 5/1940 Metzger ..... 213/170
2,408,653 A * 10/1946 Kinne ..... 213/153
3,245,553 A * 4/1966 Cope ..... 213/212
3,491,899 A * 1/1970 Cope ..... 213/159
3,598,250 A * 8/1971 Terlecky et al. ..... 213/162
3,774,777 A * 11/1973 Monzi ..... 213/159
5,139,161 A * 8/1992 Long ..... 213/124
2007/0084818 A1* 4/2007 Brabb et al. ..... 213/100 R
2007/0114199 A1* 5/2007 Kandoth-Kannoth et al. .... 213/166

* cited by examiner

*Primary Examiner*—Jason C. Smith
(74) *Attorney, Agent, or Firm*—James Ray & Assoc.

(57) ABSTRACT

A cut lever apparatus that automatically actuates a lock lift assembly to either lock or unlock a coupler knuckle of a freight car coupler. The apparatus includes a cylinder member having a piston disposed therein. A bracket member is attachable to the freight car coupler to support the cylinder. A linkage member is connected to the piston of the cylinder and the lock lift assembly to convert a lateral motion of the piston to a curvilinear motion of the lock lift assembly to either lock or unlock the coupler knuckle. A valve member is connected to the cylinder for communicating a pressurized fluid to the cylinder when a predetermined signal is sent to the valve and preventing pressurized fluid from entering the cylinder in an absence of the predetermined signal. Pressurized fluid in the cylinder is vented to atmosphere when the valve shuts off supply of pressurized fluid thereto.

11 Claims, 3 Drawing Sheets

AUTOMATIC CUT LEVER APPARATUS

CROSS REFERENCE TO RELATED APPLICATION

This application is closely related to and claims priority benefit from U.S. Provisional Patent Application Ser. No. 60/738,295 filed on Nov. 18, 2005.

FIELD OF THE INVENTION

The present invention relates, in general, to railroad freight car couplers that utilize a manually activated lock lift assembly to lock and unlock a coupler knuckle and, more particularly, the invention relates to an electro-pneumatic cut lever apparatus that is engageable with the lock lift assembly of the railroad freight car coupler to automatically activate the lock lift assembly to lock and unlock the coupler knuckle.

BACKGROUND OF THE INVENTION

Prior to the conception and development of the present invention, as is generally well known in the prior art, mechanical couplers used to couple railroad freight cars and locomotives together have been in existence for many years. Some components of the couplers include a coupler body, a coupler knuckle, a knuckle pin and a lock lift assembly.

Currently, in order to uncouple freight cars, a trainman must manually raise the lock on at least one car using a lever arm, or cut lever, attached to the end of the car. This unlocks the couple knuckle and allows the freight cars to be separated. However, this manual uncoupling of the freight cars is not without several risks of injury to the trainman.

One obvious risk of injury is the physical strain upon the trainman having to lift the cut lever. Another risk relates to the proximity of the trainman to the train line air hose. More specifically, upon separation of the freight cars from each other for a sufficient distance, the air pressure that is left in the train line can cause a whip like action of the air hose. Also, there is a chance that a quick release of air can cause particles of debris to fly.

In view of the above noted health and safety risk factors to railroad personnel, a need exists for an alternative to having the trainman manually lift the cut lever of the coupler's lock lift assembly in order to uncouple the freight cars.

SUMMARY OF THE INVENTION

The present invention provides an automatic cut lever apparatus engageable with a lock lift assembly of a railroad freight car coupler for actuating the lock lift assembly to automatically lock and unlock a coupler knuckle of the railroad freight car coupler. The automatic cut lever apparatus includes a cylinder member having a piston disposed therein. The apparatus also has a bracket member that attaches to the railroad freight car coupler to support the cylinder member. Then, a linkage member is connected to the piston of the cylinder member and the lock lift assembly to convert a lateral motion of the piston to a curvilinear motion of the lock lift assembly to lock and unlock the coupler knuckle. Finally, a valve member is connected to the cylinder member to communicate pressurized fluid to the cylinder member when a predetermined signal is sent to the valve member and to prevent pressurized fluid from entering such cylinder member in an absence of the predetermined signal. Pressurized fluid in the cylinder member is able to be vented to atmosphere when the valve member shuts off supply of pressurized fluid thereto.

OBJECTS OF THE INVENTION

It is, therefore, one of the primary objects of the present invention to provide an electro-pneumatic cut lever apparatus that is attachable to a manually activated lock lift assembly of a railroad freight car coupler and capable of automatically activating the lock lift assembly to lock and unlock the coupler knuckle.

Another object of the present invention is to provide an automatic cut lever apparatus that utilizes pressurized air already available on at least one of the coupled railroad freight cars to perform a lock lift operation in order to uncouple the cars.

Still another object of the present invention is to provide an automatic cut lever apparatus that only requires a low power electrical signal to initiate a lock lift operation in order to uncouple the cars.

Yet another object of the present invention is to provide an automatic cut lever apparatus that can be easily retrofitted to existing couplers.

Still yet another object of the present invention is to provide an automatic cut lever apparatus that significantly minimizes the hazards of uncoupling railroad freight cars.

A further object of the present invention is to provide an automatic cut lever apparatus that can be manually overridden if necessary.

In addition to the above described objects and advantages of the present invention, various additional objects and advantages of the automatic cut lever apparatus according to the instant invention will become more readily apparent to those persons skilled in the relevant art from the following more detailed description, particularly, when such description is taken in conjunction with the attached drawing figures and with the appended claims.

Figure 1:
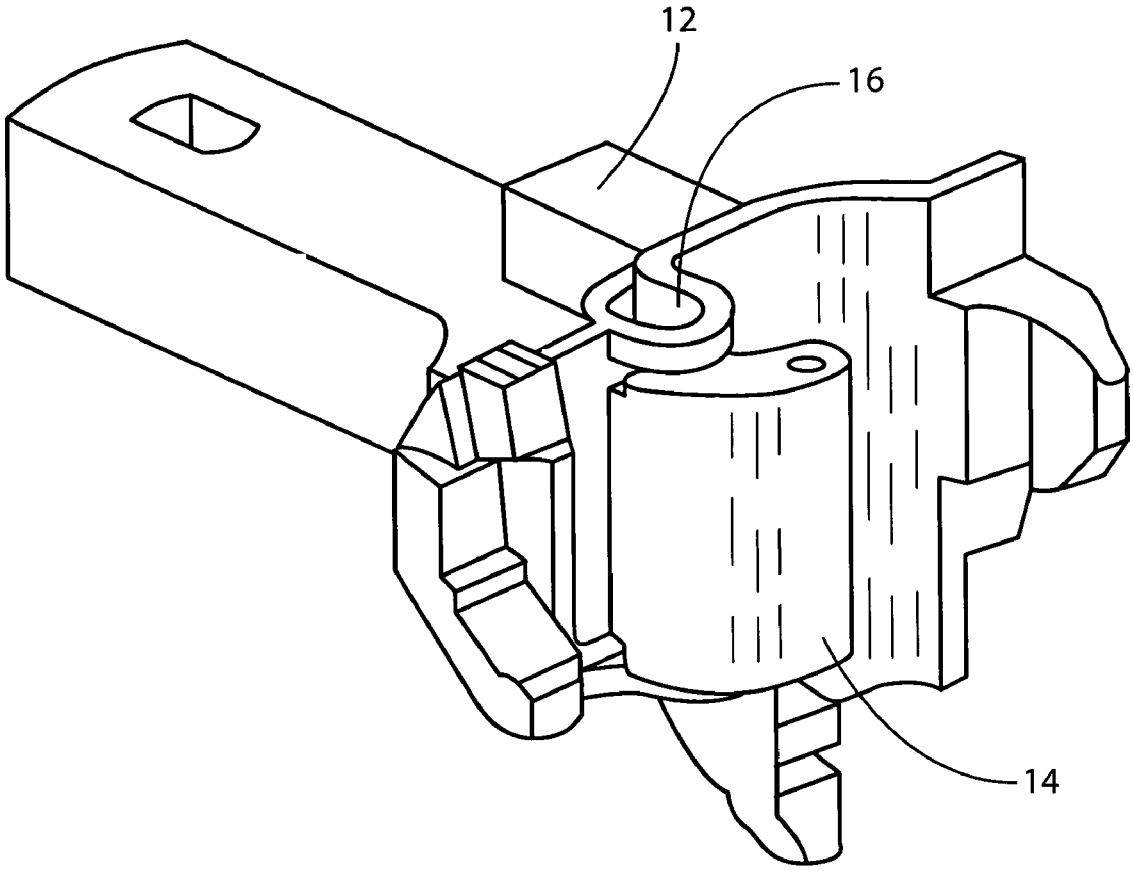
FIG. 1 is a perspective view of a prior art railroad freight car coupler.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity in understanding the invention, identical components having identical functions have been identified with identical reference numerals throughout the several views illustrated in the drawings.

FIG. 1 illustrates a type of prior art railroad freight car coupler that the present invention can be used with. The coupler includes a coupler body 12, a coupler knuckle 14, a knuckle pin 16 and a lock lift assembly (not shown).

Figure 2:
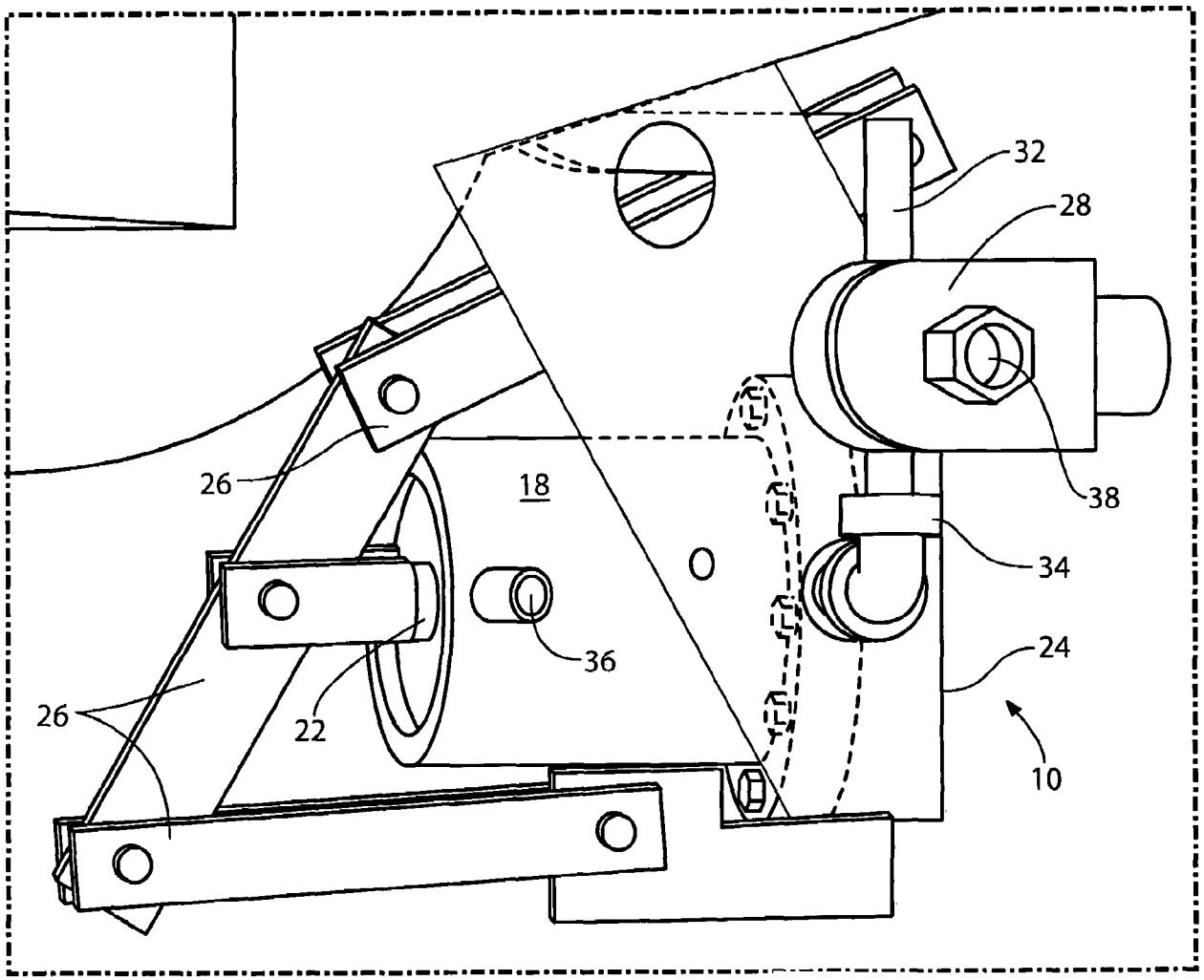
FIG. 2 is a side view of the automatic cut lever apparatus in a closed (default) position.
Figure 3:
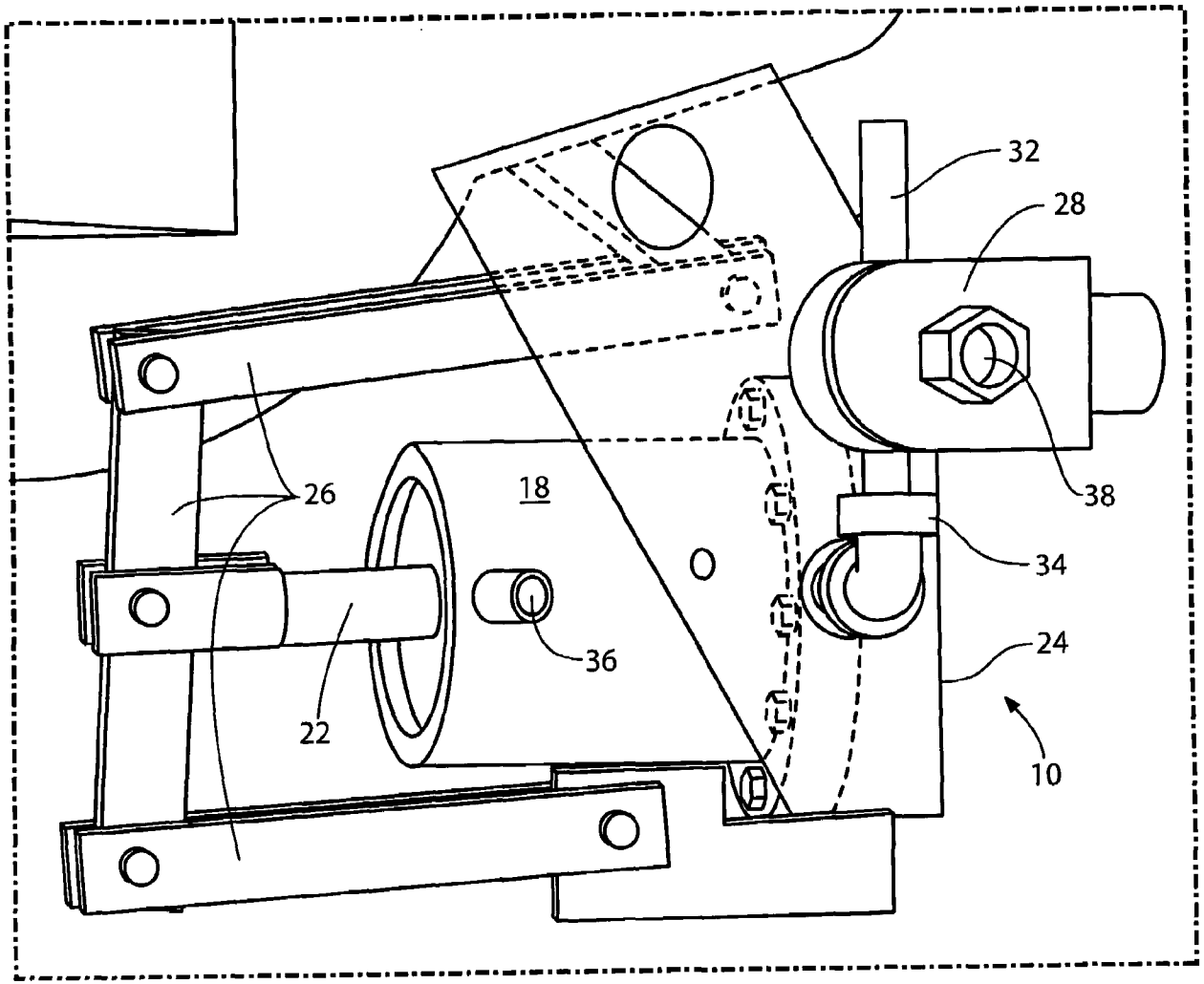
FIG. 3 is a side view of the automatic cut lever apparatus, illustrated in FIG. 2, in an open (actuated) position.

Now reference is made, more particularly, to the drawing FIGS. 2 and 3. Illustrated therein is an automatic cut lever apparatus, generally designated 10, for actuating the lock lift assembly to automatically at least one of lock and unlock the coupler knuckle 14 of the railroad freight car coupler 12. The automatic cut lever apparatus 10 includes a cylinder member 18 which has a piston 22 disposed therein. The automatic cut lever apparatus 10 also includes a bracket member 24 that attaches to the railroad freight car coupler 12 to support the cylinder member 18.

A linkage member 26 is connected to each of the piston 22 of such cylinder member 18 and the lock lift assembly for converting a lateral motion of piston 22 to a curvilinear motion of such lock lift assembly to either lock or unlock the coupler knuckle 14. Finally, a valve member 28 is connected to the cylinder member 18 for either communicating pressurized fluid to the cylinder member when a predetermined signal is sent to the valve member 28 or preventing pressurized fluid from entering the cylinder member 18 in an absence of the predetermined signal.

The automatic cut lever apparatus 10 will, preferably, include a first pipe 32 having a first end connected to a predetermined source of pressurized fluid, which is preferably a train line (not shown) of the railroad freight car (not shown) and a second end connected to the inlet side of valve member 28 for communicating the pressurized fluid to such valve member 28.

The automatic cut lever apparatus 10 will, preferably, further include a second pipe 34 having a first end connected to the outlet side of valve member 28 and a second end connected to the cylinder member 18 for communicating pressurized fluid from the valve member 28 to the cylinder member 18 when such predetermined signal is sent.

Now to describe how the automatic cut lever apparatus 10 operates. The cylinder member 18, which is preferably a pneumatic cylinder, is supplied with pressurized air from the valve member 28, which is preferably a normally closed three-way solenoid valve, when the predetermined signal, which is preferably an electrical signal, is sent. The pressurized air in turn forces the piston 22 out thus lifting the lock (see FIG. 3). As air enters the pneumatic cylinder 18 on a front side of the piston 22, air behind the piston 22 is evacuated through a first vent member 36. The linkage member 26 converts the lateral motion of the piston 22 to the curvilinear motion of the lock lift assembly.

In the absence of an electrical signal, the three-way solenoid valve 28 is closed thus preventing pressurized air from entering the pneumatic cylinder 18. Also, the pneumatic cylinder 18 can vent to atmosphere in the closed position of valve 28 back through second pipe 34 and out a second vent member 38. This allows the lock to drop and the pneumatic piston 22 to retract via the weight of the linkage member 26 to the closed (default) position (see FIG. 2).

While a presently preferred and various alternative embodiments of the present invention have been described in detail above it should be understood that various other embodiments of the invention can be envisioned by those persons skilled in the relevant art without departing from the spirit of the invention or the scope of the appended claims.

We claim:

1. An automatic cut lever apparatus engageable with a lock lift assembly of a railroad freight car coupler for actuating such lock lift assembly to automatically at least one of lock and unlock a coupler knuckle of such railroad freight car coupler, said automatic cut lever apparatus comprising:

(a) a cylinder member having a piston disposed for reciprocal movement therein;

(b) a bracket member attachable to such railroad freight car coupler for supporting said cylinder member;

(c) a linkage member connected to said piston of said cylinder member and such lock lift assembly for converting a lateral motion of said piston to a curvilinear motion of such lock lift assembly to such at least one of lock and unlock such coupler knuckle, said linkage member including a first link attached to said piston, a second link pivotally connected mediate its end to a distal end of said first link, a third link having one end thereof pivotally connected to one end of said second link and a forth link having one end thereof pivotally connected to an opposed end of said second link; and (d) a valve member connected to said cylinder member for at least one of communicating a pressurized fluid to said cylinder member when a predetermined signal is sent to said valve member and preventing such pressurized fluid from entering said cylinder member in an absence of said predetermined signal, such pressurized fluid in said cylinder member is vented to atmosphere when said valve member shuts off supply of such pressurized fluid thereto.

2. An automatic cut lever apparatus, according to claim 1, wherein said cylinder member is a pneumatic cylinder.

3. An automatic cut lever apparatus, according to claim 1, wherein said valve member is a normally closed three-way solenoid valve.

4. An automatic cut lever apparatus, according to claim 3, wherein said predetermined signal is an electrical signal.

5. An automatic cut lever apparatus, according to claim 1, wherein said automatic cut lever apparatus further includes a first pipe having a first end connected to a predetermined source of pressurized fluid and a second end connected to said valve member for communicating such pressurized fluid to said valve member.

6. An automatic cut lever apparatus, according to claim 5, wherein said automatic cut lever apparatus further includes a second pipe having a first end connected to said valve member and a second end connected to said cylinder member for communicating such pressurized fluid from said valve member to said cylinder member when said predetermined signal is sent.

7. An automatic cut lever apparatus, according to claim 5, wherein such predetermined source of pressurized fluid is a train line of such railroad freight car.

8. An automatic cut lever apparatus engageable with a lock lift assembly of a railroad freight car coupler for actuating such lock lift assembly to automatically at least one of lock and unlock a coupler knuckle of such railroad freight car coupler, said automatic cutlever apparatus comprising:

(a) a pneumatic cylinder having a piston disposed therein;

(b) a bracket member attachable to such railroad freight car coupler for supporting said pneumatic cylinder;

(c) a linkage member connected to said piston of said pneumatic cylinder and such lock lift assembly for converting a lateral motion of said piston to a curvilinear motion of such lock lift assembly to such at least one of lock and unlock such coupler knuckle, said linkage member including a first link attached to said piston, a second link pivotally connected mediate its end to a distal end of said first link, a third link having one end thereof pivotally connected to one end of said second link and a forth link having one end thereof pivotally connected to an opposed end of said second link; and (d) a threeway solenoid valve connected to said pneumatic cylinder for at least one of communicating pressurized air to said pneumatic cylinder when an electrical signal is sent to said threeway solenoid valve and preventing such pressurized air from entering said pneumatic cylinder in an absence of said electrical signal, such pressurized air in said pneumatic cylinder is vented to atmosphere when said three-way solenoid valve shuts off supply of such pressurized air thereto.

9. An automatic cut lever apparatus, according to claim 8, wherein said automatic cut lever apparatus further includes a first pipe having a first end connected to a predetermined source of pressurized air and a second end connected to said threeway solenoid valve for communicating such pressurized air to said three-way solenoid valve.

10. An automatic cut lever apparatus, according to claim 9, wherein said automatic cut lever apparatus further includes a second pipe having a first end connected to said three-way solenoid valve and a second end connected to said pneumatic cylinder for communicating such pressurized air from said three-way solenoid valve to said pneumatic cylinder when said electrical signal is sent.

11. An automatic cut lever apparatus, according to claim 9, wherein such predetermined source of pressurized air is a train line of such railroad freight car.

* * * * *